US005509940A

United States Patent [19]

Zbar et al.

[11] Patent Number: 5,509,940

[45] Date of Patent: Apr. 23, 1996

[54] PROCESSES AND COMPOSITIONS FOR DYEING HYDROPHOBIC POLYMER PRODUCTS WITH DISPERSE DYES AND TERPENE/TERPENOID SOLVENTS

[75] Inventors: Jack J. Zbar, Marietta; Robert B. Collier, Cohutta; Philip G. Carlson, Dalton, all of Ga.

[73] Assignee: Arrow Engineering, Inc., Dalton, Ga.

[21] Appl. No.: 330,217

[22] Filed: Oct. 27, 1994

Related U.S. Application Data

[63] Continuation of Ser. No. 841,424, Feb. 26, 1992, abandoned.

[51] Int. Cl.[6] ..... C09B 67/00; D06P 1/16; D06P 3/26; D06P 3/54

[52] U.S. Cl. ..... 8/617; 8/531; 8/550; 8/636; 8/900; 8/907; 8/908; 8/922; 8/924; 8/DIG. 21

[58] Field of Search ..... 8/550, 527, 617, 8/938, 531, 900, 922, 924, DIG. 21, 636, 907, 908

[56] References Cited

U.S. PATENT DOCUMENTS

| | | | |
|---|---|---|---|
| 3,653,799 | 4/1972 | Schimmel | 8/18 |
| 3,925,094 | 12/1975 | Papenfuss et al. | 8/552 |
| 3,951,598 | 4/1976 | Arashi et al. | 8/169 |
| 4,559,150 | 12/1985 | Becker et al. | 8/648 |
| 4,561,991 | 12/1985 | Herbots et al. | 252/118 |
| 4,585,820 | 4/1986 | Defago et al. | 524/232 |
| 4,636,424 | 1/1987 | Amemiya et al. | 428/198 |
| 5,092,907 | 3/1992 | Riblet et al. | 8/645 |
| 5,213,624 | 5/1993 | Williams | 134/40 |

FOREIGN PATENT DOCUMENTS

| | | |
|---|---|---|
| 8099478 | 4/1972 | Japan . |
| 50-083573 | 11/1973 | Japan . |
| 1603047 | 11/1981 | United Kingdom . |

OTHER PUBLICATIONS

Fairchild's Dictionary of Textiles, Fairchild Publications Inc., New York, 1975, p. 402, col. 1.

*The Chemistry of Synthetic Dyes,* vol. III, K. Venkataraman, 1970, p. 385.

*Primary Examiner*—Paul Lieberman
*Assistant Examiner*—Caroline L. Dusheck
*Attorney, Agent, or Firm*—Needle & Rosenberg

[57] ABSTRACT

The present invention provides a process for dyeing hydrophobic polymer fibers, including the step of contacting the goods with an amount of a dyeing solution effective to dye the goods, wherein the solution comprises an amount of a terpene/terpenoid solvent and a dyestuff. The present invention also provides a composition for dissolving and dispersing a dyestuff for dyeing hydrophobic polymer fibers, including effective amounts of a terpene/terpenoid solvent for dissolving the dyestuff.

22 Claims, No Drawings

PROCESSES AND COMPOSITIONS FOR DYEING HYDROPHOBIC POLYMER PRODUCTS WITH DISPERSE DYES AND TERPENE/TERPENOID SOLVENTS

This application is a continuation of application Ser. No. 07/841,424, filed Feb. 26, 1992, now abandoned.

BACKGROUND OF THE INVENTION

The present invention relates to processes and compositions for dyeing hydrophobic polymer fibers such as polyester, polyester blends, nylon, nylon blends and polyester/nylon blends.

The typical polyester dye is a disperse dye. Conventionally, polyester and polyester blend disperse dye carrier/levelers consist of a fiber swelling solvent and an emulsifier package. The emulsifier package, which contains one or more emulsifiers stabilizes the final carrier/leveler product and allows the solvent to be dispersed evenly in water.

Disperse dyeing processes are typically used to dye products (goods) including carpet, flatgoods, yarns and finished goods made at least in part of hydrophobic polymer filaments or fibers including polyester, nylon, polyacrylonitrile and polyurethane (E. R. Trotman (ed.) "Dyeing and Chemical Technology of Textile Fibers," Sixth Ed., Charles Griffin and Co. Ltd., High Wycomb, 1984).

The typical disperse dyeing systems used in the art include water-based processes. Water provides a medium in which to disperse the solvent and dye to facilitate contact of the dye with all areas of the goods being dyed in order to produce level dyeing of the goods. In addition, the water-based processes permit utilization of nearly all of the dye in the dyeing solution.

Typical disperse dyeing processes utilize a dyeing solution comprising a carrier/leveler composition (solvent and emulsifier), dyestuffs and water. The dyestuff dissolves in the solvent and the emulsifier disperses the solvent containing dissolved dyestuff into the water. The dye bath is then heated to temperature ranging from about 180° F. to about 212° F. The goods to be dyed are put in contact with the dye bath by various standard means.

Although not thoroughly understood, the general principle by which hydrophobic polymer fibers and filaments and various blends of those fibers are dyed is by the use of a carrier/leveler composition containing a solvent for the dyestuff that swells the polyester fiber, thus, opening the molecular pattern of the fiber to enlarge the interstitial spaces and allowing the dye to "move into" the fiber and dye the fiber. It has been known that solvents, such as aromatic and halogenated aliphatic hydrocarbons and phenols, accelerate the adsorption and absorption of disperse dyes into the fiber. Thus, the solvent portion of the dyeing solution is called a carrier.

Solvents in which the typically hydrophobic disperse dyes are soluble are not water soluble. Therefore, the carrier/leveler must include an emulsifier in order to avoid an oil/water type of interface which would cause spotty or unlevel dyeing. The emulsifier disperses the solvent portion of the carrier in water. This emulsifier generally consists of at least one chemical that contains both a hydrophobic and hydrophilic portion on the same molecule. The solvent containing the dissolved disperse dyes is attracted to the hydrophobic portion of the emulsifier (leveler) while the hydrophilic portion of the emulsifier distributes itself evenly in the water. The result is that the solvent and dyestuff are dispersed evenly in the dyeing solution and form a solvent film on the fiber, which causes level dye application. Thus, this disperse dyeing process is known as level dyeing and the composition which is used in the dyeing solution with the dyestuff and water is called a carrier/leveler.

Polyester dye carrier/leveler compositions for use in traditional disperse dyeing processes have usually had less than 2% water as a component. If more than 3% to 5% water is present, the final product is usually milky white and usually requires a special stabilizer to prevent stratification. An example of a traditional polyester dye carrier/leveler consists of 25% to 40% biphenyl, 5% to 25% emulsifier and 40% to 65% of a traditional, hazardous solvent. Traditional solvents include aromatic hydrocarbons and ethers: biphenyl, methylbiphenyl, diphenyl oxide, naphthalene, 1-methyl naphthalene, 2-methylnaphthalene, dimethylbenzene (xylene) and methylethylbenzene; halogenated aromatic hydrocarbons: monochlorotoluene, 0-dichlorobenzene and 1,3,5 trichlobenzene; halogenated aliphatic hydrocarbons: trichloroethylene and methylene chloride; aromatic esters: methyl benzoate, butyl benzoate and benzyl benzoate; phthalates: dimethyl phthalate, diethyl phthalate, diallyl phthalate and dimethyl terephthalate; and phenolits: orthophenyl-phenols and methylcresotinate.

Disperse dyeing processes are known for the dyeing of nylon fibers and filaments. The traditional nylon disperse dyeing process uses a leveling agent comprising a transester of a fatty acid, such as coconut fatty acid reacted with an ethoxylated nonylphenol. The transester molecule has both a hydrophobic (fatty acid) end and a hydrophilic (ethoxy) end. The hydrophobic end attracts the hydrophobic disperse dyestuff, while the hydrophilic end allows the leveling agent and dyestuff to disperse in the water of the dye bath. The hydrophobicity of the nylon fiber attracts the dyestuff which is brought in close contact to the surface of the fiber where it can then be absorbed into the fiber.

Processes for dyeing hydrophobic polymer fibers are known which do not disperse the solvent carrier and dye in water. These processes, known as "solvent dyeing" processes, have the disadvantages of requiring a higher concentration of solvent on the weight of the goods, compared to disperse dyeing processes, which makes the process more costly, in terms of solvent costs, solvent recovery costs and the costs of removing the solvent from the dyed material. In addition, the solvent dyeing processes are more dangerous to workers and to the environment.

It has long been known that many of the traditional solvents, used in disperse dyeing, are hazardous to the environment and the public health. Thus far, efforts to develop an effective substitute for traditional solvents that does not have the same environmental impact as traditional solvents have been unsuccessful.

Terpenes, such as the terpene hydrocarbon d-limonene, have been used as biodegradable scours for textiles produced from both synthetic and natural fibers as well as blends. Scouring is a process whereby contaminants, such as spinning oils, and natural oils on natural fibers, are removed from fibers before dyeing to facilitate adsorption and absorption of the dyestuff on the fiber. In disperse dyeing batch processes, scours are not generally used.

SUMMARY OF THE INVENTION

The present invention provides a process for dyeing hydrophobic polymer goods, including the step of contacting the goods with an amount of a dyeing solution effective to dye the goods, wherein the solution comprises an amount of a terpene/terpenoid solvent and a dyestuff. The present invention also provides a composition for dissolving and dispersing a dyestuff for dyeing hydrophobic polymer goods, including effective amounts of a terpene/terpenoid solvent for dissolving the dyestuff.

The present invention relates to a process and compositions for dyeing hydrophobic polymer goods, including goods or products containing at least some filaments or fibers made of polyester, nylon, polypropylene, acrylic, polyurethane, and various blends of those fiber types. Unlike the traditional polyester dye carrier/leveler, the present invention includes a terpene hydrocarbon, a terpenoid hydrocarbon, or mixture thereof that functions as the fiber swelling portion and as the dye solvent and fiber penetrating agent (carrier). The emulsifiers (levelers) of the present invention disperse the solvent and dyestuff in sufficient water to facilitate contact of the dyestuffs with the interstitial spaces of the fiber, resulting in level dye application.

The present invention demonstrates that terpene hydrocarbons and terpenoid hydrocarbons successfully act as solvents and fiber swelling agents in the dyeing of polyester, nylon, polyacrylonitrile and other hydrophobic polymer fibers with or without biphenyl or other traditional disperse dye solvents, and, therefore, surprisingly can avoid the use of hazardous solvents in polyester disperse dyeing.

Thus, it is an object of the present invention to provide a hydrophobic polymer fiber disperse dyeing process and compositions that employ solvents that are not currently listed as hazardous solvents. This process avoids hazardous solvents while still providing for efficient, economical level dyeing.

It is an object of this invention to provide a solvent composition for dyeing hydrophobic polymer fibers that is effective at lower concentrations than traditional solvents.

It is a further object of this invention to provide a hydrophobic polymer fiber dyeing process and composition that use environmentally superior solvents compared to previous processes and traditional compositions.

A still further object of the present invention is to provide a hydrophobic polymer fiber dyeing process and composition that are safer than traditional processes and solvents for workers in a production setting.

Yet a further object of the present invention is to provide a hydrophobic polymer fiber dyeing carrier/leveler composition that can successfully include a higher percentage of water than can be used in the traditional disperse dye carrier/leveler.

While the present invention is susceptible to embodiment in various forms, there are hereinafter described in detail presently preferred embodiments of the present invention, with the understanding that the present disclosure is to be considered as an exemplification of the invention without limitation to the specific embodiments discussed.

DETAILED DESCRIPTION OF THE PREFERRED EMBODIMENT

The present invention provides a process for dyeing hydrophobic polymer goods, including the step of contacting the goods with an amount of a dyeing solution effective to dye the goods, wherein the solution comprises an amount of a terpene/terpenoid solvent and a dyestuff. The term "dyestuff," as used herein, can denote any substance constituting a dye, but more particularly pertains to hydrophobic disperse dyes used to dye hydrophobic polymer goods. Such dyes are known and available in the art.

The present invention also provides a composition for dyeing hydrophobic polymer goods that includes an amount of a terpene/terpenoid solvent effective to dissolve a dyestuff. Typically, the compositions of this invention will also include an amount of an emulsifier effective to disperse the terpene/terpenoid solvent and the dyestuff in the water of the dyeing solution. The present compositions can also include a percentage of water that can range up to 75% by weight of the total carrier/leveler composition.

Hydrophobic polymer goods are defined as carpet, flat-goods, yarns, knits, woven and nonwoven goods, finished goods, textiles and other goods, comprised at least in part of hydrophobic polymer filaments or fibers. The terms "filament" and "fiber" are used synonymously herein and denote extruded hydrophobic polymers of various lengths and cross-sectional shapes. Examples of hydrophobic polymer fibers include the following fiber types: polyesters (typically, polyol reacted with a short to medium chain acid); nylons; polypropylenes (typically, a polymer of propylene); and acrylics (polyacrilonitrites) and polyurethanes. Nylons generally comprise an amine (for example, hexamethylene tetramine) reacted with an acid (for example adipic acid or capralactam). Examples of nylons include nylon 66, nylon 6 and nylon 473. Polyacrylonitriles generally comprise a polymer of acrylonitrile, which can be reacted with a copolymer to influence dyeability. Polyurethanes generally comprise a polymer of a glycol, polyester or polyether reacted with toluene diisocyanate. Hydrophobic polymer goods can comprise blends of various hydrophobic polymer fiber types, as well as blends of hydrophobic polymer fibers with natural fibers, including cotton and wool, and synthetic hydrophilic polymer fibers such as rayon. Methods of making goods comprising these and other hydrophobic polymer fiber types and blends of fiber types are known in the art. (E. R. Trotman (ed.) "Dyeing and Chemical Technology of Textile Fibers," Sixth Ed., Charles Griffin and Co. Ltd., High Wycomb, 1984).

As with traditional disperse dyeing processes, the process of the present invention includes the step of contacting the goods to be dyed with a dyeing solution comprising a dyestuff and a terpene/terpenoid solvent for the dyestuff. The dyeing solution of the present process typically also includes water and an amount of emulsifier effective to disperse (emulsify) the solvent and dissolved dyestuff in the water. The terpene/terpenoid based compositions of this invention can be used in the process of this invention as a portion of the dyeing solution. In embodiments of the terpene/terpenoid based compositions that include both a terpene/terpenoid solvent and an emulsifier, the composition can be used in a dyeing solution having water and dyestuff, wherein the terpene/terpenoid solvent will dissolve the dyestuff and the emulsifier will disperse the solvent and dissolved dyestuff in the water of the dyeing solution.

With reference to the process and compositions of the present invention, the term "terpene/terpenoid" means one or more terpene hydrocarbons, one or more terpenoid hydrocarbons or a mixture of one or more terpene hydrocarbons with one or more terpenoid hydrocarbons. The terpene hydrocarbons of the present process and compositions are compounds based on the isoprene (2-methyl-1,3-butadiene) molecular unit and can be of any number of carbons and may include a variety of substituents. However, the preferred terpene/terpenoid solvents will be liquid at room temperature. Methods of making the terpene hydrocarbons of the present invention are known in the art.

Disperse dyes are generally 100% soluble in the terpene/terpenoid solvents of the present invention. To be effective in the disperse dyeing process and compositions of the present invention, the terpene/terpenoid compounds must both dissolve hydrophobic dyestuffs and swell the hydrophobic polymer fibers of the goods being dyed. To determine the effectiveness of a terpene/terpenoid compound as a solvent for the dyestuff, the dyestuff is added to the terpene/terpenoid and the solution is visually assessed for clarity, indicating approximately 100% dissolution. To test the terpene/terpenoid solvent for fiber swelling ability for a particular fiber type, a fiber of known length is placed in the solvent and, after approximately 45 minutes to 1 hour, at a standardized temperature the length of the fiber is measured. If the fiber shortens as a result of contact with the terpene/terpenoid solvent, it is concluded that the solvent swelled the fiber.

The following are classes and examples of terpene hydrocarbons which are expected to be effective solvents for use in the instant invention:

| |
|---|
| monoterpenes (10 carbons) |
| d-limonene (d-1-methyl-4-(methylethenyl) cyclohexene) |
| α-pinene (2,6,6-trimethylbicyclo [3.1.1] hept-2-ene) |
| β-pinene (6,6-dimethyl-2-methylenebicyclo [3.1.1]heptane) |
| β-myrcene (7-methyl-3-methylene-1,6-octadiene) |
| sesquiterpenes (15 carbons) |
| β-selinene |
| zingiberene |
| diterpenes (20 carbons) |
| abietic acid |
| polyterpenes (>20 carbons) |
| squalene |
| terpene amines |
| terpene halogens |

The terpenoid hydrocarbons of the present process and compositions are defined as oxygen-containing terpenes and include the classes of terpene ketones, terpene aldehydes, terpene alcohols and carboxyterpenes. Methods of making the terpenoid hydrocarbons of the present invention are known in the art. Examples of terpenoid hydrocarbons expected to be effective in the present process include the following:

| |
|---|
| terpene ketones |
| GLIDSOL 175 (SCM Glidco Organics, Jacksonville, Florida) |
| GLIDSOL 140 (SCM Glidco Organics) |
| terpene aldehydes |
| citral (3,7-dimethyl-2,6-octadienal) |
| citronellol (3,7-dimethyl-6-octen-1-01) |
| terpene alcohols |
| GLIDSOL 140 (SCM Glidco Organics) (blend of terpene alcohols and terpene ketones) |
| GLIDSOL 175 (SCM Glidco Organics) (blend of terpene alcohols and terpene ketones) |
| carboxylated terpenes |
| abietic acid |

The preferred terpene/terpenoid solvents of this invention can be selected from a group including the following examples:

| |
|---|
| d-limonene (4-isopropenyl-1-methylcyclohexene) (Florida Chemical Co., Florida) |
| LIMONENE 125 (SCM Glidco Organics) |
| LIMONENE 145 (SCM Glidco Organics) |
| SOLVENOL 226 (SCM Glidco Organics) |
| GLIDSOL 100 (SCM Glidco Organics) |
| GLIDSOL 140 (SCM Glidco Organics) |
| GLIDSOL 175 (SCM Glidco Organics) |
| GLIDSOL 180 (SCM Glidco Organics) |
| α-pinene |
| citral |
| citronellol |

The most preferred terpene/terpenoid solvents of this invention are as follows:

| |
|---|
| d-limonene (Florida Chemical Co.) |
| LIMONENE 125 (SCM Glidco Organics) |
| LIMONENE 145 (SCM Glidco Organics) |
| SOLVENOL 226 (SCM Glidco Organics) |
| GLIDSOL 100 (SCM Glidco Organics) |
| GLIDSOL 140 (SCM Glidco Organics) |
| GLIDSOL 175 (SCM Glidco Organics) |
| GLIDSOL 180 (SCM Glidco Organics) |

Other terpene/terpenoid solvents not specifically set forth herein are expected to be effective in the process and compositions of this invention as can be determined using the standard testing procedures described herein as well as others known in the art.

The amount of the terpene/terpenoid solvent in the carrier/leveler composition of the present invention could range as high as 95% by weight of the total composition, depending upon the lab or production requirements. The effectiveness of the terpene/terpenoid solvents of this invention in dissolving dyestuffs and swelling fiber is not appreciably impacted by the use of concentrations of the solvent of 95% or more by weight of the total composition. Therefore, it is seen that the upper concentration limits of the terpene/terpenoid solvent in the carrier/leveler composition will be determined by commercial, practical and environmental considerations rather than considerations of efficacy. A terpene/terpenoid solvent/emulsifier composition of the present invention can contain as little as 1% terpene/terpenoid solvent by weight of the total solution. The result of using such a low concentration of terpene/terpenoid solvent in the composition is that a larger amount of the composition must be used in the dyeing solution in order to effectuate the dyeing of goods.

The most preferred concentration range of terpene/terpenoid solvent in the compositions of this invention is from about 35% to about 50% by weight of the total composition, and a more preferred concentration range of the terpene/terpenoid solvent is from about 30% to about 65% by weight of the total composition, although, as explained above, a range of about 1% to about 95% by weight of the total composition can be effective.

Because water-based dyeing processes are typically used for dyeing hydrophobic polymer goods, the composition and process of the present invention will typically include an emulsifier in order to avoid a terpene/terpenoid solvent-water bilayer. The emulsifiers of the present process and composition, can be any chemical or combination of chemicals capable of forming an emulsion of the dyestuff and terpene/terpenoid solvent in water at temperatures used in disperse dyeing processes. Such temperatures are typically from 180° F. to 212° F. in atmospheric batch disperse dyeing processes, and above 212° F. in pressurized batch disperse dyeing processes. The emulsifiers of the present invention disperse the dyestuff and terpene/terpenoid solvent resulting in level dye application, similar to the function performed by emulsifiers in traditional disperse dyeing processes. The term "emulsifiers" as used herein includes one or more chemicals that meet the definition of emulsifier provided above.

The methods for formulating emulsifiers for use in the present disperse dyeing process are known to the skilled artisan. For example, the chemical characteristics of the terpene/terpenoid solvent and the hydrophilic/hydrophobic (H/H) balance of the emulsifier compounds will be the starting point in formulating a preferred emulsifier that disperses finely in water and stable at, above and below room temperature. Determination of the cloud point of the emulsifier in water can be used as an indicator of the effectiveness of a chemical as an emulsifier of this invention.

Emulsifiers for use in the present polyester dyeing process and compositions are known in art or commercially available, and can include the following or mixtures of the following:

CK 300 (Arrow Engineering, Dalton, GA)
AH COAB-146 (ICI Specialty Chemicals, Wilmington, Delaware)
ethoxylated nonylphenols (mixture of ethoxylated monoalkyl phenols with side chains comprising isomeric branched-alkyl radicals)
TRYCOL NO-10 (Henkel Inc., Charlotte, NC)
ethoxylated castor oils (ethoxylated triglycerides of fatty acids)
TRYLOX CO-10 (Henkel Inc.)
TRYLOX CO-36 (Henkel Inc.)
ethoxylated alcohols
TRYDET LA-8 (Henkel Inc.)
ethoxylated quaternary ammonium compounds
diethyl dihydrogenated tallow ammonium sulfonated quaternary compound (Arrow Engineering)
diethyl ethoxylated tallow ammonium sulfate quaternary compound (Arrow Engineering)
ethoxylated alkylaryls
ethoxylated monomer acids
ETHOX MA-8 (Ethox Chemicals, Greenville, SC) polyethylene glycol monomer acid (ethoxylated fragments of ozonated tallow oil)
sulfonated alkylaryls
phosphated alkylaryls An emulsifier of one embodiment of this invention comprises the following: calcium salt of DDBSA (dodecyl benzene sulfonic acid) ethoxylated castor oil, ethoxylated quaternary ammonium compound, and ethoxylated nonylphenol. Other emulsifiers, not specifically set forth herein can be used in present process and compositions as determined by standard means known in the art and described herein.

As with the terpene/terpenoid solvents, the effectiveness of the emulsifiers in dispersing the dyestuff and solvent will not be appreciably affected by using concentrations of emulsifiers in the terpene/terpenoid based carrier/leveler composition of up to 95% or more by weight of the total composition. Correspondingly, the upper concentrations of emulsifiers in the terpene/terpenoid solvent based compositions will be determined by environmental, practical and commercial considerations rather than considerations of effectiveness. The determination of the effective amount of emulsifier can be made by standard methods in the art based on the concentration of the terpene/terpenoid solvent and other standard considerations such as the temperature and duration of the contacting step.

A most preferred concentration of emulsifier in the terpene/terpenoid based compositions of this invention ranges from about 35% to about 50% by weight of the total composition, and a more preferred range can be from about 30% to about 65% by weight of the total composition. Least preferred, for commercial, practical and environmental reasons, is a range from about 1% to about 95% by weight of the total composition.

In an expected commercial embodiment of the present composition, comprising an emulsifier, terpene/terpenoid solvent, and water, the concentration of the terpene/terpenoid solvent is most preferably between about 35% about 50% by weight of the total composition, the concentration of the emulsifier is most preferably between about 35% and about 50% by weight of the total composition and the concentration of water is between about 0% and about 30% by weight of the total composition.

The purpose of water in the terpene/terpenoid solvent based carrier/leveler composition of the present invention is to reduce the cost of the composition to accommodate expected spillage during the makeup of the dyeing solution of the contacting step. The concentration of water in the terpene/terpenoid based carrier/leveler is preferably from about 5% to about 75% by weight of the total composition, although a higher concentration of water can be used. The actual concentration of water in the terpene/terpenoid solvent/based carrier/leveler composition will be a factor in determining what is an effective amount of the composition for use in the contacting step of the process. Specifically, the higher the concentration of water in the terpene/terpenoid based carrier/leveler composition the greater the amount of the composition that must be used in the dyeing solution in order to effectively dye the given goods. The effective amounts of terpene/terpenoid solvent and emulsifier in the dyeing solution of the contacting step of the present process will be designated by a percentage on the weight of the goods (owg), meaning a percentage of the total weight of the goods being dyed. This amount will be determined in accordance with standard disperse dye processing parameters as discussed below.

As shown in Examples 1–9, the present process and compositions are effective in the dyeing of polyester and nylon fibers. Other hydrophobic polymer goods are expected to be successfully dyed by means of the present invention based generally on their hydrophobicity characteristics. In addition to the solubility and fiber swelling tests described previously, a further standard test of effectiveness of a terpene/terpenoid solvent/based composition for a particular fiber type of hydrophobic polymer goods is the Dye Transfer Test, having the following steps: (1) place dyed goods and undyed goods together in a water bath maintained at the appropriate temperature (180° F.–212° F.); (2) add the carrier/leveler composition comprising the terpene/terpenoid solvent to be tested to the bath; (3) observe the rate of dye transfer from the dyed to the undyed goods; (4) observe the tone (shade) of the originally undyed goods as the dye is transferred thereto. A preferred composition will result in dye transfer that is rapid, level and on tone. The positive results of a dye transfer test for nylon goods are illustrated in Example 9.

A further embodiment of the present process employs a combination of one or more terpene/terpenoid solvents and one or more traditional solvents in the dissolving step. The term "traditional solvent" as used herein denotes non terpene/terpenoid compounds, including but not limited to aromatic hydrocarbons, halogenated aromatic hydrocarbons, halogenated aliphatic hydrocarbons, aromatic esters, phthalates, phenolics, and ethers. Specific examples from the above classes of chemicals include the following: aromatic hydrocarbons and ethers: biphenyl, methyl-biphenyl, diphenyl oxide, 1-methyl naphthalene, 2-methylnaphthalene, dimethylbenzene (xylene) and methylethylbenzene; halogenated aromatic hydrocarbons: monochlorotoluene, 0-dichlorobenzene and 1,3,5 trichlobenzene; halogenated aliphatic hydrocarbons: trichloroethylene and methylene dichloride; aromatic esters: methyl benzoate, butyl benzoate and benzyl benzoate; phthalates: naphthalene, dimethyl phthalate, diethyl phthalate, diallyl phthalate and dimethyl terephthalate; and phenolits: orthophenyl-phenols and methylcresotinate.

An effective amount of dyestuff and terpene/terpenoid based carrier/leveler composition used in the dyeing solution of the present process is an amount capable of dyeing hydrophobic polymer fiber the appropriate shade with minimal crocking and sufficient colorfastness. The amount of the terpene/terpenoid solvent based carrier/leveler composition effective to dye hydrophobic polymer goods will depend upon the concentration of terpene/terpenoid solvent and emulsifier in the composition, along with such well-known polyester dyeing process parameters as the dyeability of the fiber or yarn, the production conditions such as hot or cold dye application for the continuous process, the depth of the desired dye shade, the dwell time in the horizontal or vertical steamer, the auxiliary chemicals which may be used in the same dye bath, foreign substances or spinning oils on the yarn or fiber, the duration of the dye cycle, the rate of temperature rise in the dye cycle, the method of cooling or rinsing the yarn, etc. Other parameters not specifically mentioned herein, but known in the art can also be considered.

The contacting step of the hydrophobic polymer goods dyeing process of the present invention will follow the usual parameters of traditional polyester dyeing processes except as otherwise specified herein. An illustration of such polyester dye contacting parameters is presented above and in Example 1. The process and compositions of the present invention can be used in both batch and continuous dyeing processes. In the contacting step of the present invention, the amount of dyeing solution effective to dye hydrophobic polymer goods is determined in accordance with the standard process parameters listed above. More specifically, the size and shape of the dyeing vessel, along with the amount of goods to be dyed and the amount of those goods to be contacted with the dyeing solution at any given time, will determine the amount of dyeing solution in the contacting step effective to dye the goods.

Ranges of terpene/terpenoid based solvent composition amounts used in the dyeing solution of process of this invention can be from 0.125% to 15% on the weight of the goods. Example 6 illustrates the successful use of as little as ½% owg of the terpene/terpenoid based composition of this invention. Additional testing has shown that as little as 0.125% owg of the terpene/terpenoid solvent based carrier/leveler composition should be effective. As previously described, the amount of the terpene/terpenoid solvent based compositions used in the dyeing solution to effectively dye hydrophobic polymer goods will depend on the concentrations of terpene/terpenoid solvent and other components in the composition.

The terpene/terpenoid solvents and emulsifiers of the present process are not limited to the compositions specifically taught by the present invention. Thus, the amounts of terpene/terpenoid solvent in the dyeing solution effective to dye the goods in the present process can be determined independently of other components in the dyeing solution, based on the weight of the goods being dyed. These amounts, which can be determined by standard means based on standard process parameters, range from about 0.125% terpene/terpenoid solvent owg for light shades to about 10.0% terpene/terpenoid solvent owg for very dark shades. As little 0.065% owg of the terpene/terpenoid solvent in the dyeing solution is expected to be effective for dyeing very light shades. Greater than 10% owg of the terpene/terpenoid solvent in the dyeing solution of the contacting step will be effective, but will generally be wasteful of the solvent and dyestuff. The amount of terpene/terpenoid solvent effective in a particular process can be determined by standard means without undue experimentation using the standard process parameters listed above.

In the process of the present invention the emulsifiers used in the dyeing solution of the contacting step are not limited to the emulsifier formulations specifically mentioned herein. The amount of emulsifier effective in a particular process for particular hydrophobic polymer goods can be determined by standard means based on the amount of the terpene/terpenoid solvent in the dyeing solution and other standard process parameters described above. Typically and depending on standard considerations, the amount of emulsifier can range from about 0.0375% owg to about 10% owg, although smaller amounts may also be effective in a particular process. As with the terpene/terpenoid solvent, larger amounts will be effective, but will be impractical for commercial and environmental reasons.

The amount of dyestuff used in the present process will depend predictably on factors that are typically considered in disperse dyeing, including the desired shade and others listed above.

Because the terpene/terpenoid solvents of the present invention are more effective than traditional solvents, lower terpene/terpenoid solvent amounts and emulsifier amounts can be used in the present process to obtain the same quality product, compared with traditional solvents. As a result, the terpene/terpenoid solvent based carrier/leveler composition and process of the instant invention are environmentally superior and have a reduced chemical oxygen demand (COD) value compared to traditional solvents and processes. The COD value is used as a measure of the oxygen consumed by the organic matter content of a sample during oxidation by a strong chemical oxidant (Standard Methods for the Examination of Water and Waster Water, 16th Ed., American Public Health Association, 1985). Thus, the lower COD value of the present invention results in less oxygen being required to biodegrade the terpene/terpenoid solvent residues in the effluent streams produced by the present process.

Some examples of terpene/terpenoid solvent and emulsifier compositions that may be used to practice the process of the present invention are listed below:

| |
|---|
| d-Limonene |
| Ethoxylated Nonylphenols |
| Water |
| d-Limonene |
| Ethoxylated Nonylphenols |
| Ethoxylated Monomer Acids |
| Water |
| d-Limonene |
| Ethoxylated Nonylphenols |
| Coconut Ester Blend |
| Water |
| Limonene 125 |
| Sulfonated Alkylaryl |
| Ethoxylated Alkylaryl |
| Ethoxylated Quaternary |
| Compound |
| Water |

When the dissolving step further includes adding a traditional solvent to the solution the following carrier/levelers can be used:

| |
|---|
| d-Limonene |
| Monochlorotoluene |
| (traditional solvent) |
| Ethoxylated Nonylphenols |
| Water |
| d-Limonene |
| Alkyl Phthalamide |
| (traditional solvent) |
| Ethoxylated Nonylphenols |
| Phosphated Nonylphenol |
| Water |
| d-Limonene |
| Biphenyl (traditional solvent) |
| Ethoxylated Nonylphenols |
| Coconut-ester Blend |
| Water |

The concentrations of the components in the above-listed compositions will fall within the preferred, more preferred and most preferred concentration ranges provided above. The amount of the above-listed compositions that can be used in the dyeing solution of the present process will usually fall within the owg amount ranges provided above.

Thickeners can also be used in the compositions of the present invention. Thickeners are either natural (gum) or synthetic (acrylic) substances that increase the viscosity or interval resistance to flow and aid in suspending non-compatible materials together. Examples of suitable thickeners include guar gum and polysaccharide xanthan gums, such as KELZAN AR (Kelco, Rahway, N.J.). Thickeners can be used in concentrations from about 0.2% to about 4% of the total weight of the composition solution. Compatibilizers can also be used in the compositions of the present invention to prevent stratification of the components in the composition, thus assisting in maintaining a stable and homogeneous solution. Compatibilizers can comprise between about 2% and 20% of the total weight of the composition.

Although the disperse dyeing process uses water in the dyeing solution, the dyeing process of the present invention can also be practiced in the absence of water in which case no emulsifier is required in the dyeing solution. In this alternative process, known as "solvent dyeing", the material being dyed is contacted directly by the terpene/terpenoid solvent containing the dissolved dyestuff. This alternative process is more costly, less efficient and more environmentally disadvantageous. The compositions of the present invention also include a terpene/terpenoid solvent for a dyestuff which can be used in a solvent dyeing process as described above. In this terpene/terpenoid composition for use in the dyeing solution of a solvent dyeing process, an emulsifier is not required and water is not usually included.

EXAMPLES

Example 1

The terpenoid compound 4-isopropenyl-1-methylcyclohexene (d-limonene) was emulsified with a combination of the calcium salt of dodecylbenzene sulfonic acid, ethoxylated castor oil, and ethoxylated quaternary compound, and an ethoxylated nonylphenol.

The carrier/leveler composition included the following:

| | |
|---|---|
| d-limonene (Florida Chemical Co., Florida) | 40% |
| water | 48.4% |
| guar gum | 00.6% |
| diethylene glycol | 01% |
| (to dissolve the gum) | |
| ethylated monomer acid | 04% |
| emulsifiers: | 06% |
| monoethanolamine salt of | .32 |
| dodecyl benzene sulfonic acid | |
| ethoxylated castor oil | .38 |
| ethoxylated quaternary compound | .15 |
| ethoxylated nonylphenol | .15 |

The amount of the composition used was 1% owg. The dyestuffs comprised disperse yellow 54, disperse red 60, and disperse blue 56, The dyeing solution pH was 6.25–6.5, adjusted using MSP (monosodium phosphate) powder. An EDTA (ethylene diamine tetraacetic acid) sequestrant was added to the dyeing solution at 0.5% concentration. A sequestrant complexes with or chelates undesirable metallic cations, thus reducing their undesirable effects on dyes and other components of the dye bath.

The carpet was dyed in an atmospheric beck, a large open vat containing a dyeing solution comprising the above-specified terpene/terpenoid solvent based composition, dyestuff and water. The dye cycle was 45 minutes with the dyeing solution at or near boiling. A "patch" was taken to compare the shade to a standard. The dyeing solution was dropped, the carpet rinsed with clear, cold water and no additional chemicals were used. If the procedure had required chemicals in the rinse, this terpene/terpenoid solvent carrier would not interfere with the rinsing chemicals.

In order to evaluate the success of the present process, the dyed goods were compared to goods dyed by a concurrently run traditional process using 5% of a biphenyl/monochlorotoluene based solvent carrier. Both processes produced goods that were level, on shade and on tone to each other and to standard.

Example 2

Example 2 illustrates that polyester can be successfully dyed using a terpene/terpenoid based composition. A light beige shade using disperse yellow 54, red 60 and blue 56 in a dyeing solution adjusted to a pH of 5.5–6.0 using acetic acid, was applied to polyester carpet. The following table outlines the experiment.

| A | B | C |
|---|---|---|
| Blank (dye only) | 3% terpene based carrier/leveler (owg) | 3% terpene based carrier leveler (owg) |

A: No terpene/terpenoid compound
B: 40% terpene (d-limonene), 10% emulsifier (ethoxylated monomer acid, monoethanolamine salt of DDBSA, ethoxylated castor oil, ethoxylated nonylphenol, ethoxylated quaternary compound), 2% thickener, 48% water
C: 45% terpene (d-limonene), 25% emulsifier (monoethanolamine salt of DDBSA, 2-butoxyethanol, ethoxylated castor oil, ethoxylated nonylphenol, ethoxylated quaternary compound), 30% water
Sample A: Inadequate yellow fixation, some residual dye in the bath
Sample B: Dyed on tone, clean bath
Sample C: Dyed on tone, clean bath The results illustrate that a dyeing solution comprising a terpene/terpenoid solvent successfully dyes polyester.

Example 3

In a dyeing process using 3% owg of a carrier/leveler composition comprising:

| | |
|---|---|
| 45% terpene | |
| 25% emulsifier: | monoethanolamine salt of DDBSA:<br>2-butoxyethanol;<br>ethoxylated castor oil;<br>ethoxylated nonylphenol;<br>ethoxylated quaternary compound |
| 30% water | |

the following terpene/terpenoids were found to be effective solvents in the level dyeing of a gray shade:

| |
|---|
| d-limonene |
| LIMONENE 125 (SCM Glidco Organics) |
| LIMONENE 145 (SCM Glidco Organics) |
| SOLVENOL 226 (SCM Glidco Organics) |
| GLIDSOL 100 (SCM Glidco Organics) |
| GLIDSOL 140 (SCM Glidco Organics) |
| GLIDSOL 175 (SCM Glidco Organics) |
| GLIDSOL 180 (SCM GLidco Organics) |

Example 4

Example 4 consists of a test for colorfastness to Xenon light using the test method as directed in AATCC (American Association of Textile Chemists and Colorists) Test Method 16E-1987. Briefly, a piece of the dyed good is subjected to light from a xenon-arc lamp for a specified length of time and intensity and a specified temperature and humidity. The amount of color fading of the dyed good is then determined by comparison of the tested good with a standard reference fabric of the industry such as Xenon Reference Fabric (AATCC, Research Triangle Park, N.C.) or other suitable reference material (AATCC Technical Manual 1990:44–46). In this example, ratings were made as directed in AATCC Procedure No. 1 (replaced by Section 9, Test Method 16-1987, p. 35), in which the tested material is compared to a standard scale of gray chips representing a difference in color or contrast (shade and strength) corresponding to a numerical fastness rating. The results of the colorfastness tests are rated by visually assessing the tested fabric against the scale and comparing those results with a piece of nontested material (AATCC Technical Manual 1990:34–35).

Numerical Fastness Scale

5. Negligible or no change
4. Slightly changed
3. Noticeably changed
2. Considerably changed
1. Much changed

| Sample Test Number | % Carrier/ Leveler (owg) | AATCC Fading Units | Rating |
|---|---|---|---|
| 002 | 2% | 20 | 5 |
| | | 40 | 4 |
| | | 60 | 3 |
| 003 | 5% | 20 | 5 |
| | | 40 | 4 |
| | | 60 | 3 |
| 004 | 10% | 20 | 5 |
| | | 40 | 4 |
| | | 60 | 3 |
| 005 | 1% | 20 | 5 |
| | | 40 | 4 |
| | | 60 | 3 |
| 006 | 1% | 20 | 5 |
| | | 40 | 4 |
| | | 60 | 3 |

Carrier/leveler composition for
002: 40% terpene, 10% emulsifier, 2% thickener, 48% water (See Example 2, Sample B)
003: 45% terpene, 25% emulsifier, 30% water (See Example 2, Sample C)
004: 70% traditional solvent (aromatic hydrocarbon: monochloratolvene), 24% biphenyl, 6% emulsifier
005: 50% terpene (d-Limonene), 10% emulsifier (DDBSA, ethoxylated castor oil, ethoxylated nonylphenol, ethoxylated quaternary compound), 40% leveler/compatibilizer (CK-300; coconut fatty acid transester condensate (Arrow Engineering, Dalton, GA)).
006: Same as 003

The test shade was a medium gray consisting of disperse dyes yellow 54, red 60 and blue 56.

Disperse dyes characteristically have limited light fastness properties. The results of this test show that at varying percentage application levels (owg), the terpene/terpenoid based carrier/levelers perform equally as well as the traditional solvent-biphenyl based carrier (Sample 004).

Example 5

A test was done to compare the wet and dry crock of disperse dyes on polyester using the new invention versus a typical solvent-biphenyl based carrier. Crock or crocking is a measure of the transfer of dye from the surface of a dyed yarn or fabric to another surface or to an adjacent area of the same fabric principally by rubbing. Wet crock is measured before the fabric is dried. Dry crock is measured after drying the fabric. The trials were based on a modification of the AATCC Test Method 8-1988. Briefly, a piece of dyed material is rubbed with white crock test cloth and any color transferred to the white test cloth is assessed by visual comparison with an unused white crock test cloth. The dyestuffs consisted of a yellow 54, red 60 and blue 56. The pH of the dyeing solution was adjusted to 5.5–6.0 using acetic acid.

In a split solution of the dyestuffs, four trials were run. They were labeled as follows:

| A | B | C | D |
|---|---|---|---|
| Blank (dye only) | 3% terpene based carrier/ leveler | 10% terpene based carrier/ leveler (owg) | 10% traditional solvent-biphenyl based carrier (owg) |

B: See Example 2, Sample C
C: See Example 2, Sample C

| | Medium Gray Shade: | |
|---|---|---|
| Sample | Wet Crock | Dry Crock |
| A | Moderate | Slight |
| B | Slight | None |
| C | Slight | None |
| D | Slight | None |

| | Dark Gray Shade: | |
|---|---|---|
| Sample | Wet Crock | Dry Crock |
| A | Heavy on shade crock | Yellow crock |
| B | Yellow crock | Slight tonal crock |
| C | Yellow crock | Slight tonal crock |
| D | Slight wet crock | Slight tonal crock |

Tonal crock denotes a condition where all of the colors that comprise a dye tone rub off together as opposed to only one or a subset of the component colors rubbing off. The terpene based carrier/leveler gave results generally the same as the traditional solvent-biphenyl based carrier/leveler. All shades were deep, on tone and of equal levelness.

Example 6

A Beck production run of 1091 pounds was made (dye lot AG108). A light blue gray shade consisting of disperse yellow 54, red 60 and blue 56 was made. The dye cycle required one dye add to obtain the desired shade. The carrier/leveler composition consisted of 50% terpene/terpenoid solvent (see Example 3, Sample 005), and 50% emulsifier (see Example 3, Sample 005). One-half percent (½%) owg of the terpene/terpenoid based carrier/leveler composition was used in the dyeing solution with the above dyestuffs, MSP, sequestrant (EDTA) and an additional coconut-based emulsifier. No biphenyl or traditional solvent was required. In a previous production run using the same yarn, the same color formula and the same components of the dyeing solution except for the solvent and emulsifier, 5% of a traditional solvent-biphenyl carrier/leveler was used instead of the terpene/terpenoid solvent. The shade from the terpene/terpenoid solvent carrier and the traditional solvent carrier were the same. Thus, the present invention was successfully used to dye polyester carpet on a commercial scale.

Example 7

A test similar to Example 6 was made, dyeing 1523 pounds of carpet (dye lots AC389 and AC405) a reddish beige color using the same dyestuffs. All other process parameters were similar to Example 6. 1% owg of the terpene/terpenoid based composition from Example 6 was used. Again, a successful dyeing was made. Five percent (5%) owg of a traditional polyester solvent carrier was used on the same yarn and color in previous production runs. Both the terpene/terpenoid based carrier/leveler composition and the traditional solvent carrier/leveler gave the same acceptable color results but less of the terpene/terpenoid solvent based composition was required.

Example 8

The goods dyed in this trial, using an Ahiba dye unit, was a 62 oz. superba set: a 50/50 blend of 825 TREVIRA (Hoechst Celanese Corp.) polyester yarn and 828 "high shrink" TREVIRA (Hoechst Celanese Corp.) polyester yarn. The shades used for this trial were beige, green, cranberry and gray. All shades were obtained using disperse yellow 54, disperse red 60 and disperse blue 56. The following percentages of dyestuffs for the shades listed are based on the weight of the goods. The pH of the dyeing solution was 6.5.

| | Beige | Green | Cranberry | Gray |
|---|---|---|---|---|
| Yellow 54 | .0073 | .02 | .03 | .0145 |
| Red 60 | .0073 | .0085 | .25 | .0275 |
| Blue 56 | .0046 | .125 | .055 | .0545 |

In actual production conditions, using the traditional process 5% owg of a traditional solvent/biphenyl carrier is required to obtain the beige and green shade, 6% owg for the gray and 8% owg for the cranberry. The same amount of biphenyl/solvent carrier was used in this lab trial. Using the terpene/terpenoid composition of the present invention specified in Example 3, only 1% owg of this terpene/terpenoid based composition was required to obtain the beige, green and gray shades. The cranberry shade required only 4% owg of the composition of the present invention to obtain the same full shade and tone compared to the production process requiring 8% owg of a traditional solvent/biphenyl based carrier.

Example 9

Nylon carpet, Allied type 6 (Allied Signal, Petersburg, Va.) was dyed a deep rose color using Cibacet yellow 2GC (disperse yellow 3, Ciba Geigy Corp., Greensboro, N.C.), EGN (Ciba Geigy Corp.) and Cibacet Blue CRS (Ciba Geigy Corp). In a lab trial using a Beck dye lab table, a dyed 10 g swatch and an undyed 10 g swatch were placed back-to-back in a water bath. Two percent (2%) owg of the appropriate terpene/terpenoid solvent based composition (See Example 3) was used in the solution, adjusted to pH 6.5, and the dye transfer from the dyed to the undyed goods were evaluated. The following describes the transfer results:

| Blank (dye only) | Traditional nylon disperse dye leveler | Terpene/terpenoid carrier/leveler |
|---|---|---|
| Moderate | Good | Best |

The terpene/terpenoid solvent composition gave an almost equal transfer shade. These results indicate that a terpene/terpenoid solvent based composition will also effectively act as a disperse dye solvent and emulsifier on nylon fibers and nylon yarns.

Example 10

A terpene/terpenoid based carrier/leveler composition of this invention was formulated as follows:

| | |
|---|---|
| d-Limonene | 40% |
| ethoxylated castor oil (CO-36) | 14% |
| ethoxylated castor oil (CO-10) | 04% |
| ethoxylated lauryl alcohol (LA-8) | 01% |
| Water | 30% |
| 1-butoxyethanol | 10% |

The above composition was used in a dyeing solution to dye polyester and was found to effectively dye the polyester goods.

Example 11

A formulation using AH COAB-146 (ICI Specialty Chemicals)- 26%, d-limonene (Florida Chemical Co.)-45% and water 29% was successfully prepared and used in a laboratory situation.

Various other examples and modifications of the foregoing description will be apparent to a person skilled in the art without departing from the spirit and scope of the invention, and it is intended that all such examples and modifications be included within the scope of the appended claims. The references cited above are hereby incorporated by reference to more fully disclose the invention.

What is claimed is:

1. A process for dyeing polyester fibers or nylon fibers comprising the step of contacting the fibers with an amount of a dyeing solution effective to dye the fibers, wherein the solution comprises an amount of a terpene/terpenoid solvent and a hydrophobic disperse dye, wherein the terpene/terpenoid solvent completely dissolves the hydrophobic disperse dye, and wherein the terpene/terpenoid solvent is one or more terpene hydrocarbons, one or more terpenoid hydrocarbons, or a mixture of one or more terpene hydrocarbons with one or more terpenoid hydrocarbons.

2. The process of claim 1, wherein the dyeing solution further comprises water and an amount of an emulsifier effective to disperse the hydrophobic disperse dye and terpene/terpenoid solvent in the water.

3. The process of claim 2, wherein the emulsifier is selected from the group consisting of ethoxylated nonylphenols, coconut esters, sulfonated alkyl aryls, ethoxylated phosphated nonylphenols, ethoxylated alcohols, ethoxylated castor oil, ethoxylated quaternary ammonium compounds, ethoxylated alkylaryls and ethoxylated monomer acids.

4. The process of claim 2, wherein the amount of the terpene/terpenoid solvent in the dyeing solution is at least about 0.065% on the weight of the fibers, the amount of the emulsifier is between about 0.0375% and about 10% on the weight of the fibers.

5. The process of claim 1, wherein the dyeing solution further comprises a traditional solvent, selected from the group consisting of aromatic hydrocarbons, halogenated hydrocarbons, halogenated aliphatic hydrocarbons, aromatic esters, phthalates, phenolics and ethers.

6. The process of claim 1, wherein the amount of the terpene/terpenoid solvent in the dyeing solution is at least about 0.065% on the weight of the fibers.

7. The process of claim 1, wherein the terpene/terpenoid solvent is d-limonene.

8. The process of claim 1, wherein the fibers comprise polyester fibers.

9. The process of claim 1, wherein the fibers comprise nylon fibers.

10. The process of claim 1, wherein the terpene/terpenoid solvent comprises α-pinene or β-pinene and another terpene/terpenoid solvent.

11. The process of claim 1, wherein the terpene/terpenoid solvent is a monoterpene, sesquiterpene, diterpene, polyterpene, terpene amine, terpene halogen, terpene ketone, terpene aidehyde, terpene alcohol, carboxylated terpene, or a mixture thereof.

12. The process of claim 1, wherein the terpene/terpenoid solvent is d-limonene, β-myrcene, citral, citronellol, or a mixture thereof.

13. The process of claim 1, wherein the terpene/terpenoid solvent comprises d-limonene.

14. The process of claim 2, wherein the terpene/terpenoid solvent comprises d-limonene, and the emulsifier comprises ethoxylated castor oil and ethoxylated lauryl alcohol.

15. A composition for dyeing polyester fibers or nylon fibers, comprising an amount of hydrophobic disperse dye effective to dye the fibers, an amount of a terpene/terpenoid solvent effective to completely dissolve the hydrophobic disperse dye, water and an amount of an emulsifier effective to disperse the terpene/terpenoid solvent and hydrophobic disperse dye in water, wherein the terpene/terpenoid solvent is one or more terpene hydrocarbons, one or more terpenoid hydrocarbons, or a mixture of one or more terpene hydrocarbons with one or more terpenoid hydrocarbons.

16. The composition of claim 15, wherein the concentration of the terpene/terpenoid solvent is at least about 1% by weight of the total composition.

17. The composition of claim 15, wherein the terpene/terpenoid solvent is d-limonene.

18. The composition of claim 15, wherein the terpene/terpenoid solvent comprises α-pinene or β-pinene and another terpene/terpenoid solvent.

19. The composition of claim 15, wherein the terpene/terpenoid solvent is a monoterpene, sesquiterpene, diterpene, polyterpene, terpene amine, terpene halogen, terpene ketone, terpene aidehyde, terpene alcohol, carboxylated terpene, or a mixture thereof.

20. The composition of claim 15, wherein the terpene/terpenoid solvent is d-limonene, β-myrcene, citral, citronellol, or a mixture thereof.

21. The composition of claim 15, wherein the terpene/terpenoid solvent comprises d-limonene.

22. The composition of claim 15, wherein the terpene/terpenoid solvent comprises d-limonene, and the emulsifier comprises ethoxylated castor oil and ethoxylated lauryl alcohol.

* * * * *